US012055330B2

(12) United States Patent
Yoshikawa et al.

(10) Patent No.: US 12,055,330 B2
(45) Date of Patent: Aug. 6, 2024

(54) OUTDOOR UNIT FOR A HEAT PUMP

(71) Applicants: DAIKIN INDUSTRIES, LTD., Osaka (JP); DAIKIN EUROPE N.V., Ostend (BE)

(72) Inventors: Kouta Yoshikawa, Ostend (BE); Wim Vansteenkiste, Ostend (BE); Akshay Hattiangadi, Ostend (BE); Jose Daniel Garcia Lopez, Ostend (BE); Tom Surmont, Ostend (BE); Rishi Mehta, Ostend (BE)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 336 days.

(21) Appl. No.: 17/436,845

(22) PCT Filed: Mar. 6, 2020

(86) PCT No.: PCT/JP2020/009888

§ 371 (c)(1),
(2) Date: Sep. 7, 2021

(87) PCT Pub. No.: WO2020/184491

PCT Pub. Date: Sep. 17, 2020

(65) Prior Publication Data

US 2022/0136750 A1 May 5, 2022

(30) Foreign Application Priority Data

Mar. 8, 2019 (EP) ..... 19161608

(51) Int. Cl.
*F25B 47/02* (2006.01)
*F25B 13/00* (2006.01)

(52) U.S. Cl.
CPC ..... *F25B 47/022* (2013.01); *F25B 13/00* (2013.01); *F25B 2313/0211* (2013.01); *F25B 2347/02* (2013.01); *F25B 2600/2501* (2013.01)

(58) Field of Classification Search
CPC .... F25B 47/022; F25B 47/006; F25B 47/025; F25B 13/00; F25B 2313/0211;
(Continued)

(56) References Cited

U.S. PATENT DOCUMENTS

2015/0292756 A1* 10/2015 Takenaka ..... F24F 5/001 62/160

FOREIGN PATENT DOCUMENTS

CN 105264304 A 1/2016
EP 2 333 438 A1 6/2011
(Continued)

OTHER PUBLICATIONS

European Search Report of application 19161608.5 dated Aug. 21, 2019.

(Continued)

*Primary Examiner* — Emmanuel E Duke
(74) *Attorney, Agent, or Firm* — Birch, Stewart, Kolasch & Birch, LLP

(57) ABSTRACT

An outdoor unit for a heat pump includes a refrigerant circuit, the outdoor unit including a compressor, a discharge pipe of the refrigerant circuit connected to a discharge side of the compressor, a bottom plate, the bottom plate having a base and an outer flange protruding upward from an outer edge of the base, a heat source heat exchanger supported on the bottom plate, a liquid refrigerant pipe of the refrigerant circuit connected to the heat source heat exchanger, and a defrosting bypass pipe connected at one end to the discharge pipe and at the opposite end to the liquid refrigerant pipe, the defrosting bypass pipe being arranged between an inner side of the flange and an outer side of the heat source heat exchanger.

20 Claims, 5 Drawing Sheets

(58) Field of Classification Search
CPC ..... F25B 2313/005; F25B 2313/02741; F25B 2347/02; F25B 2600/2501
See application file for complete search history.

(56) References Cited

FOREIGN PATENT DOCUMENTS

| | | | | | |
|---|---|---|---|---|---|
| EP | 2 333 440 | A1 | | 6/2011 | |
| EP | 2333438 | A1 | * | 6/2011 | ..... F24F 1/06 |
| JP | 57-195076 | U | | 6/1982 | |
| JP | 63-178762 | U | | 11/1988 | |
| JP | 2004-69220 | A | | 3/2004 | |
| KR | 100469790 | B1 | * | 2/2005 | ..... F24F 1/56 |
| WO | WO-2010146807 | A1 | * | 12/2010 | ..... F25B 13/00 |
| WO | WO-2012014345 | A1 | * | 2/2012 | ..... F25B 1/10 |
| WO | WO 2013/051177 | A1 | | 4/2013 | |
| WO | WO-2013051177 | A1 | * | 4/2013 | ..... F24F 1/14 |
| WO | WO-2015059945 | A1 | * | 4/2015 | ..... F24F 11/30 |

OTHER PUBLICATIONS

International Search Report (PCT/ISA/210) issued in PCT/JP2020/009888 mailed on May 15, 2020.
English translation of the International Preliminary Report on Patentability and Written Opinion of the International Searching Authority for International Application No. PCT/JP2020/009888, dated Sep. 23, 2021.

* cited by examiner

[Fig. 1]
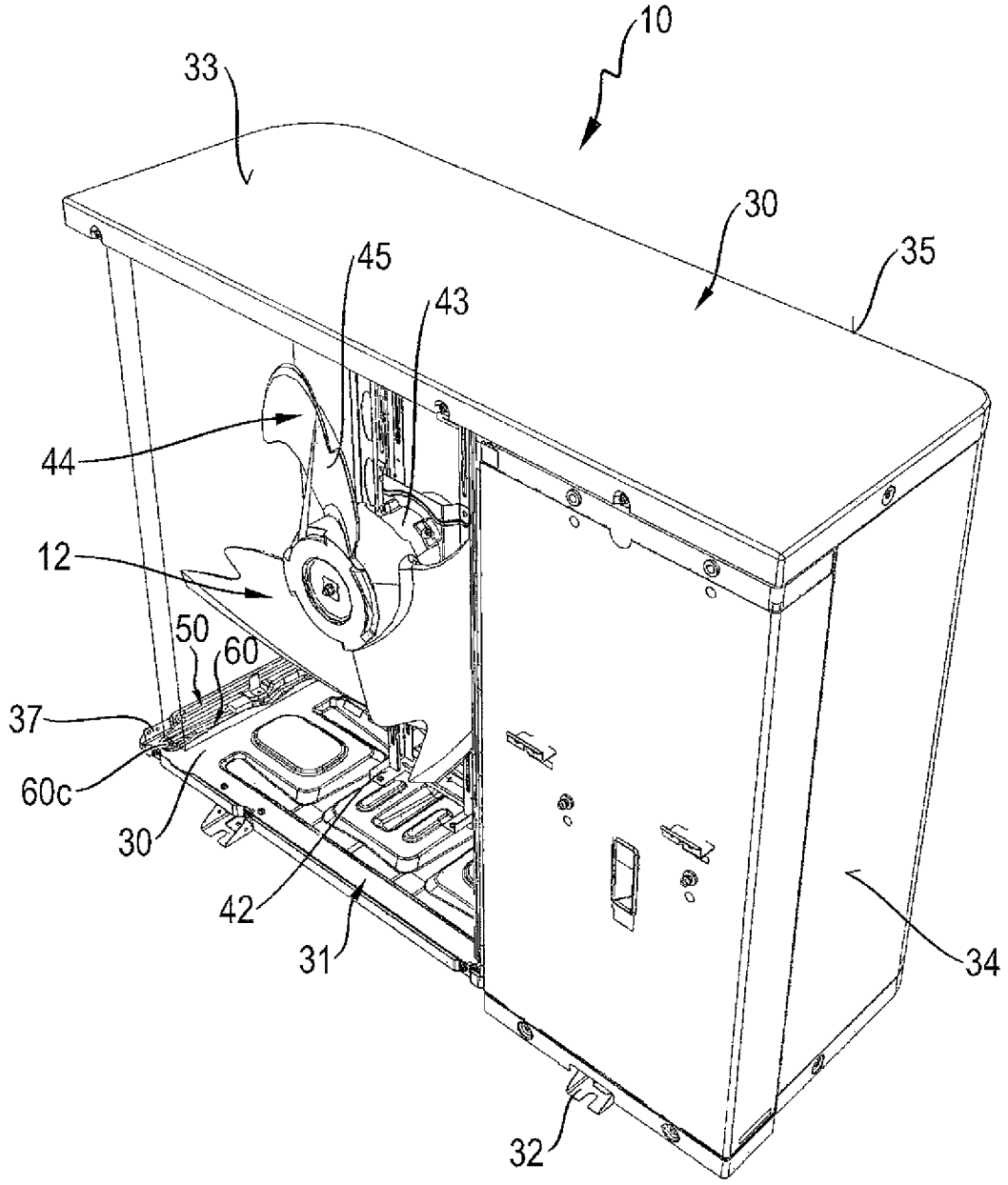

[Fig. 2]
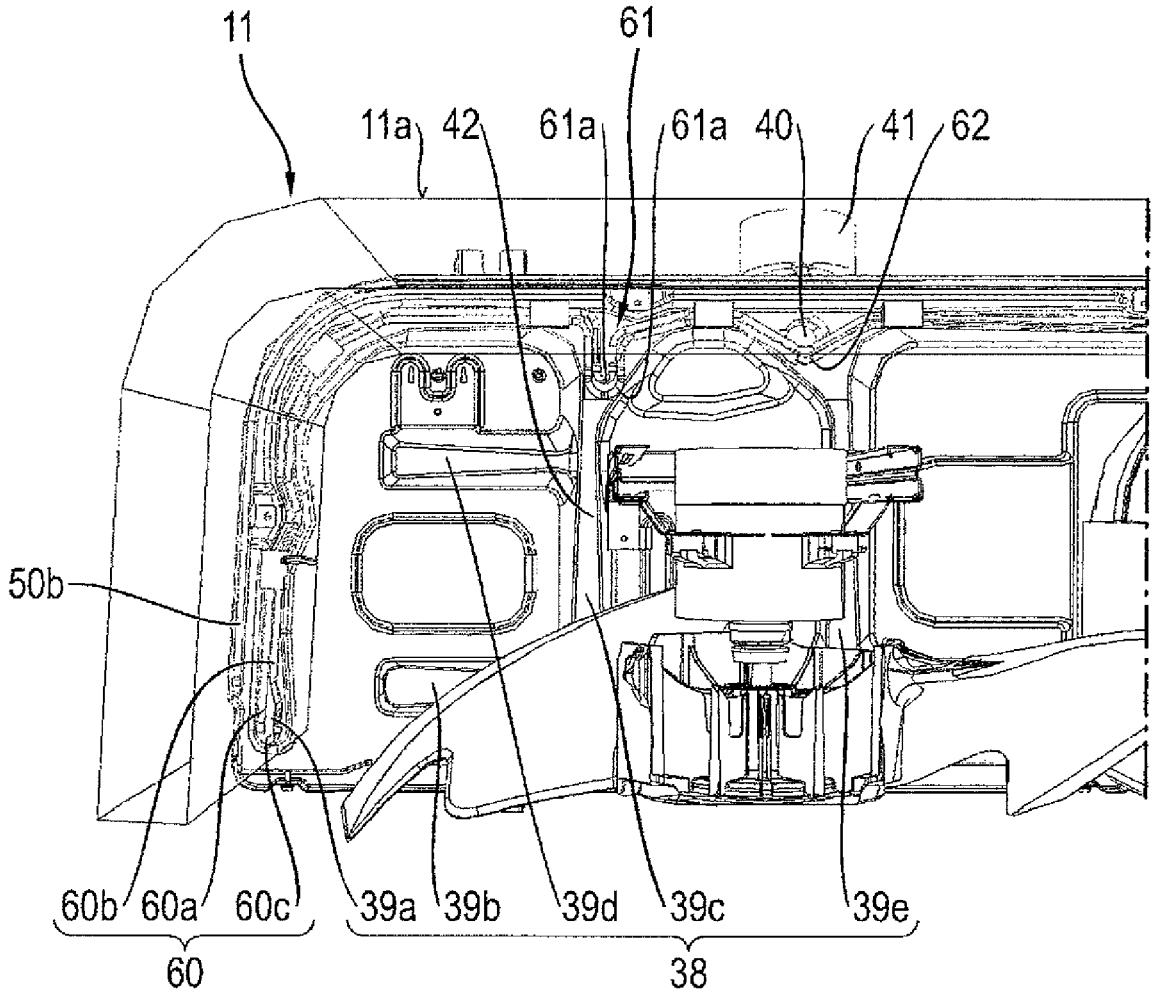

[Fig. 3]
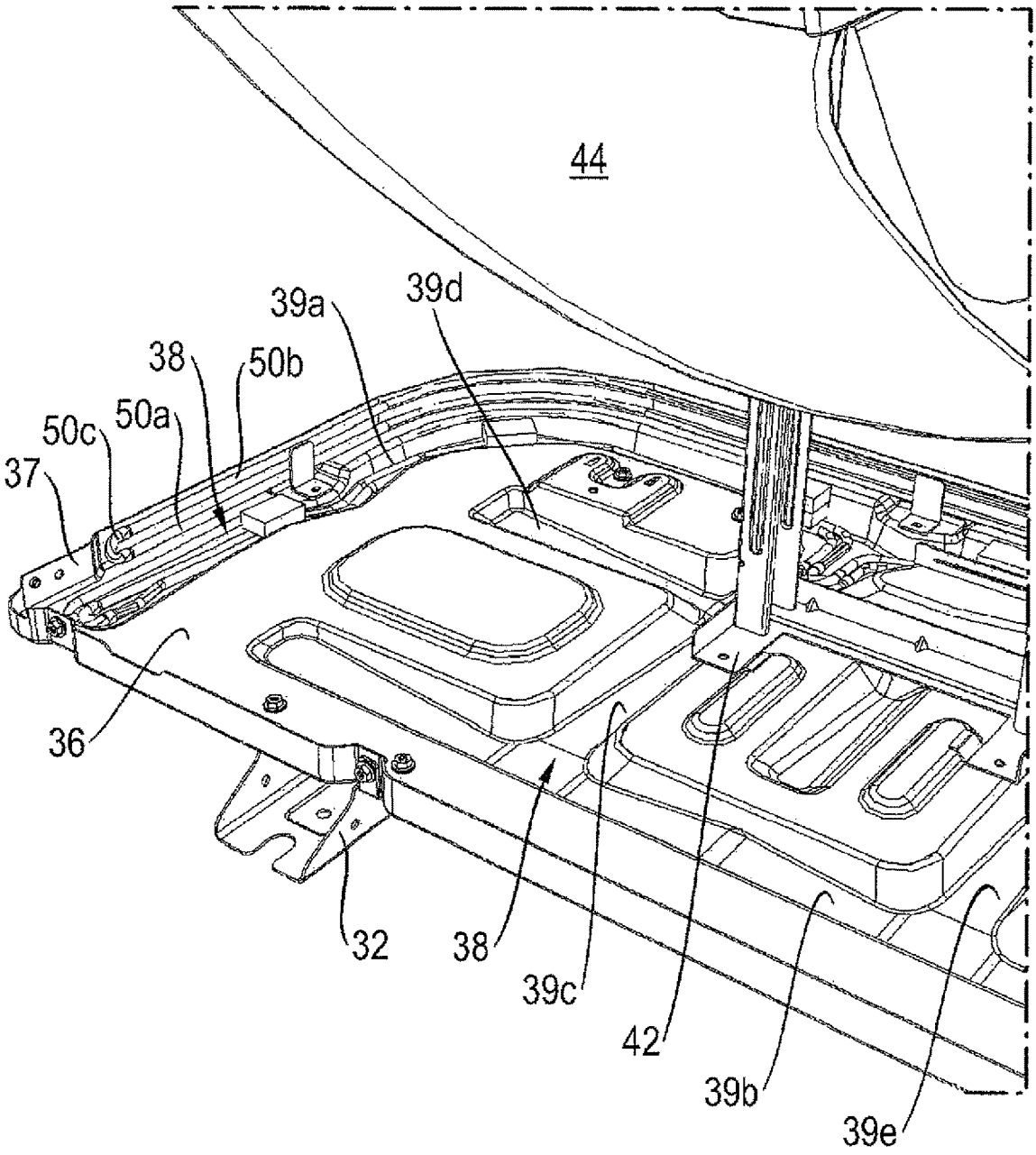

[Fig. 4]
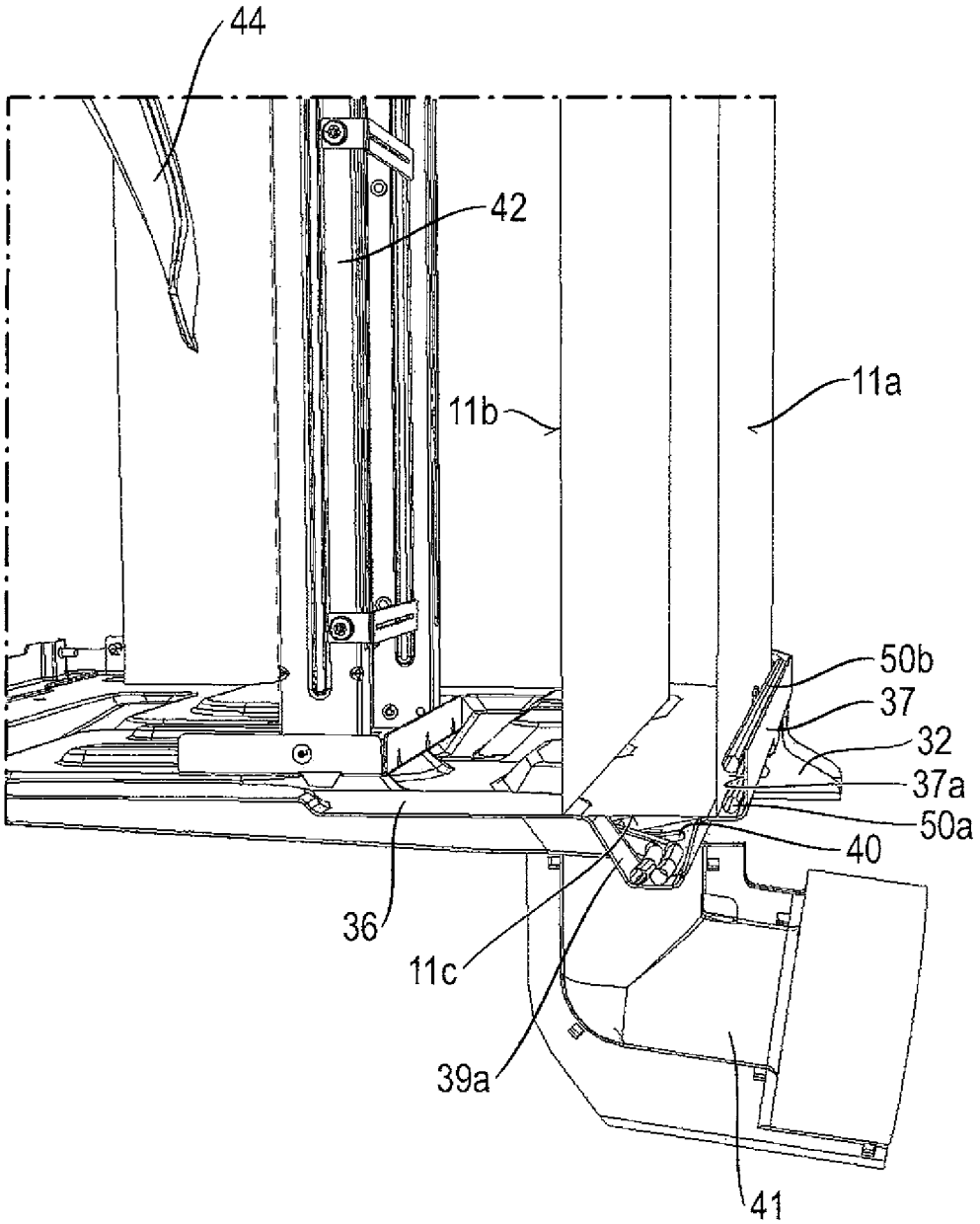

[Fig. 5]
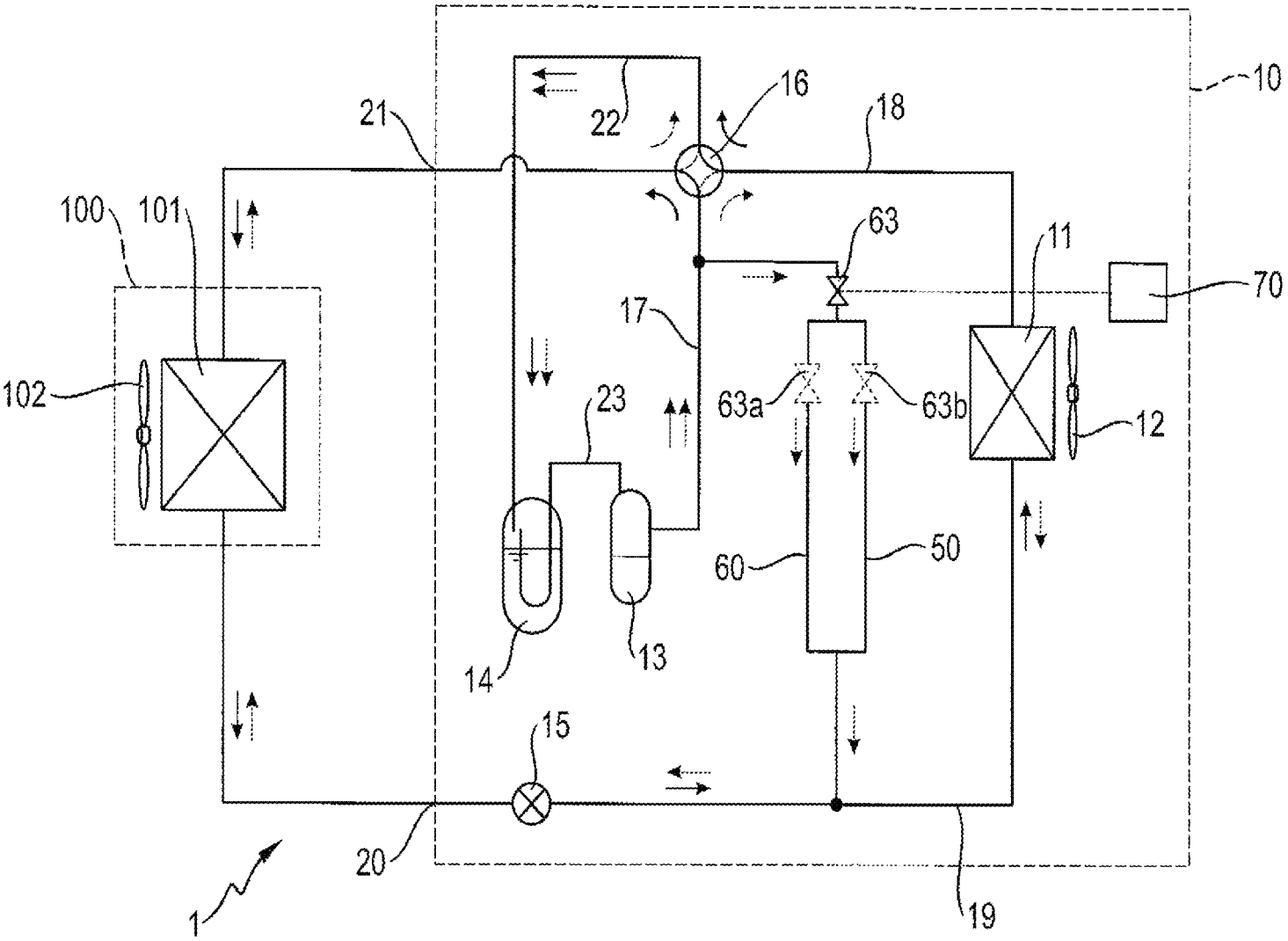

OUTDOOR UNIT FOR A HEAT PUMP

TECHNICAL FIELD

The present disclosure relates to heat pumps for cooling and/or heating purposes. In particular, the disclosure relates to split-type heat pumps comprising an outdoor unit and at least one indoor unit. Even more particular, the disclosure relates to a heat pump using air as heat source.

BACKGROUND ART

Operating the heat pump in a heating operation may cause the formation of frost at the heat source heat exchanger accommodated in the outdoor unit. During a defrosting operation of the heat pump, a reverse-cycle operation to the heating operation is performed in order to defrost the outdoor heat exchanger. Due to the reverse cycle, the heat source heat exchanger functions as a condenser dissipating heat and frost is thawed. The thawed frost (water) flows along the heat source heat exchanger towards a bottom plate comprising a drainage structure in order to drain the water.

Nevertheless, in cold weather conditions, the water tends to freeze on the bottom plate, particularly in a portion below the heat source heat exchanger blocking the drainage structure. To cope with this problem, JP S63-178762 U or EP 2333440 A1 suggest a defrosting bypass pipe connected to a discharge pipe of the compressor. The defrosting bypass pipe is positioned within the drainage structure of the bottom plate beneath the heat source heat exchanger. Thus, the defrosting bypass pipe heats the bottom plate in a portion of the bottom plate below the heat source heat exchanger during defrosting operation avoiding the formation of frost/ice within the drainage structure.

Yet, the bottom plate has in many cases an outer flange, which protrudes upward from a base. The heat source heat exchanger is with its outer side arranged on the bottom plate inside the flange. It has been found out that some of the water flowing along the heat source heat exchanger tends to freeze in the portion between the inner side of the flange and the outer side of the heat source heat exchanger.

This may lead to the problem that additional water flowing along the outer side of the heat source heat exchanger does not flow into the drainage structure on the bottom plate, but drops from an outer edge of the bottom plate to the ground. In addition, the heat exchange efficiency of the heat exchanger is reduced.

To cope with this problem it has been contemplated to dispose an electric heater on the inner side of the flange, i.e. between the inner side of the flange and the outer side of the heat source heat exchanger. Yet, this requires the provision of another type of heater (electric), an additional control to control said heater and it increases the power consumption of the heat pump.

CITATION LIST

Patent Literature

[PTL 1] JP S63-178762 U
[PTL 2] EP 2333440 A1

SUMMARY OF INVENTION

In view of the aforesaid, it is an aim of the present disclosure to provide an outdoor unit for a heat pump, which more readily prevents the formation of frost/ice between a heat source heat exchanger and the bottom plate during defrosting operation and may avoid the need of different heating means.

This aim may be achieved by an outdoor unit as defined in claim 1. Embodiments may be found in the dependent claims, the following description and the accompanying drawings.

According to a first aspect, an outdoor unit for a heat pump comprising a refrigerant circuit is suggested. The refrigerant circuit may at least comprise a heat source heat exchanger (outdoor heat exchanger), a heat consumer heat exchanger (indoor heat exchanger), an expansion valve and a compressor connected by refrigerant pipes. In addition, the refrigerant circuit may comprise a 4-way switching valve for switching between heating operation and cooling/defrosting operation (reverse cycle operation). At least the compressor and the heat source heat exchanger are comprised by the outdoor unit. Additionally, the 4-way switching valve and/or the expansion valve may be comprised by the outdoor unit.

In the first aspect, a discharge pipe of the refrigerant circuit is connected to a discharge side of the compressor. In one example, the discharge pipe connects the discharge side of the compressor and the 4-way valve.

In addition, the outdoor unit comprises a bottom plate having a base and an outer flange (or rim) protruding upward from an outer edge of the base. The outer flange is provided along at least an outer circumferential edge of the bottom plate and has an inner side opposite to an outer side. Further, the bottom plate may have a drainage structure such as one or more drainage channels and at least one drainage hole for draining water accumulated on the bottom plate and in the draining structure.

The heat source heat exchanger is supported on the bottom plate. The outdoor unit may further comprise a liquid refrigerant pipe of the refrigerant circuit. The liquid refrigerant pipe of the refrigerant circuit may connect the heat source heat exchanger and the heat consumer heat exchanger. The term "liquid refrigerant pipe" is to be understood in that the refrigerant flowing in that pipe is mainly in the liquid phase. Moreover, the outdoor unit may further comprise a refrigerant pipe connecting the heat source heat exchanger and the 4-way valve.

In order to avoid the formation of frost during a defrosting operation between the inner side of the flange and the outer side of the heat source heat exchanger, a defrosting bypass pipe (first defrosting bypass pipe) is connected at one end to the discharge pipe. According to an example, the opposite end of the defrosting bypass pipe may be connected to the liquid refrigerant pipe. Thus, the defrosting bypass pipe bypasses the heat source heat exchanger. In one example, the defrosting bypass pipe is connected between the discharge side of the compressor and the 4-way switching valve and, thus, bypasses the 4-way switching valve and the heat source heat exchanger. According to another example, the opposite end of the defrosting bypass pipe may be connected to the refrigerant pipe connecting the 4-way valve and the heat source heat exchanger. Thus, the defrosting bypass pipe bypasses the 4-way valve.

The defrosting bypass pipe is arranged between an inner side of the flange and an outer side of the heat source heat exchanger.

A valve may be provided to control the flow of refrigerant from the discharge pipe through the defrosting bypass pipe to the liquid refrigerant pipe. A controller may be provided for controlling the valve, i.e. closing the valve during normal operation and opening the valve during defrosting operation.

According to the first aspect, the formation of frost/ice between the inner side of the flange and the outer side of the heat source heat exchanger during defrosting operation is prevented. As hot gaseous refrigerant is flown through the defrosting bypass pipe during defrosting operation, which is branched off the refrigerant pipe feeding hot gaseous refrigerant to the heat source heat exchanger for defrosting, no additional and different heating structure is required.

According to a second aspect, the defrosting bypass pipe is a loop comprising an upper pipe and a lower pipe. The upper pipe and the lower pipe may be connected by a bend, such as a 180 degrees bend. In this aspect, the upper pipe is arranged further away from the base of the bottom plate than the lower pipe. To put it differently the upper pipe and the lower pipe are arranged vertically parallel.

As a result, a distance between the inner side of the flange and the outer side of the heat source heat exchanger can be kept at a minimum and it is ensured that the whole inner side of the flange and the corresponding outer side of the heat source heat exchanger are sufficiently heated during defrosting operation.

According to a third aspect, the outdoor unit further comprises an additional (second) defrosting bypass pipe connected at one end to the discharge pipe. According to an example, the opposite end of the additional defrosting bypass pipe is connected to the liquid refrigerant pipe. According to another example, the opposite end of the additional defrosting bypass pipe is connected to the refrigerant pipe connecting the 4-way valve and the heat source heat exchanger. The additional defrosting bypass pipe is arranged between the base of the bottom plate and a lower side of the heat exchanger. To put it differently, the additional defrosting bypass pipe is sandwiched between the heat source heat exchanger, particularly its lower side, and the base of the bottom plate. In case the bottom plate comprises a drainage structure, such as a drainage channel, the additional defrosting bypass pipe may be arranged within the drainage structure, such as the drainage channel.

Consequently, the formation of ice on the bottom plate is prevented and drainage of the water to the outside of the heat source heat exchanger during defrosting operation may effectively be realized.

According to a fourth aspect, the additional defrosting bypass pipe comprises an auxiliary loop, which is at least partly in a view perpendicular to the bottom plate not located below (underneath) the heat source heat exchanger. Thus, in a view perpendicular to the bottom plate (top view on the bottom plate) the auxiliary loop looks out (pokes out) from the heat source heat exchanger.

This configuration provides for certain advantages explained below.

According to a fifth aspect, the additional defrosting bypass pipe is made of at least two tubes connected to each other at a connecting portion. For example, the tubes of the additional defrosting bypass pipe are brazed at the connecting portion. The connecting portion is in this aspect positioned in the auxiliary loop so that the connecting portion is in a view perpendicular to the bottom plate not located below the heat source heat exchanger.

The likelihood that leakage within piping occurs at the connecting portions is higher than in other portions. According to this aspect, the connecting portions are more easily accessible being positioned outside the heat source heat exchanger in a top view. Hence, the connecting portions may be inspected without the need of removing the heat source heat exchanger. Thus, the serviceability of the outer unit is simplified.

According to a sixth aspect, the auxiliary loop extends towards a support structure supporting a fan on the bottom plate in a view perpendicular to the bottom plate.

In many cases, the support structure for the fan is directly fixed to the bottom plate. Yet, some water tends to accumulate on the bottom plate close to the portion at which the support structure is fixed to the bottom plate. If this water freezes, it may happen that the ice displaces the support structure. Particularly tilting of the support structure has been recognized. This may lead to problems in that fan blades of the fan may come into contact with other components within the casing of the outdoor unit leading to severe damages. In this aspect, the auxiliary loop extends towards the support structure supporting the fan, whereby the region of the bottom plate adjacent the support structure may be heated and the formation of ice be prevented.

According to a seventh aspect, the defrosting bypass pipe and the additional defrosting bypass pipe are connected in parallel.

Thus, higher flexibility regarding the control during defrosting operation is achievable.

In particular and according to an eighth aspect, a valve is arranged in each of the defrosting bypass pipe and the additional defrosting bypass pipe.

Consequently, the flow of gaseous refrigerant through the defrosting bypass pipe and the additional defrosting bypass pipe may be controlled independently.

Alternatively and according to a ninth aspect, a valve is arranged to control the flow of refrigerant from the discharge pipe through both the defrosting bypass pipe and the additional defrosting bypass pipe, preferably to the liquid refrigerant pipe or to the refrigerant pipe connecting the 4-way valve and the heat source heat exchanger.

Thus, the control is less complicated and fewer parts are required, saving costs.

According to a tenth aspect, the outdoor unit further comprises a controller, wherein the controller is configured to close the valve/-s during normal operation and to open the valve/-s during the defrosting operation.

According to an eleventh aspect, the additional defrosting bypass pipe passes around a drainage hole in the bottom plate. The term "passes around" is to be understood in that the additional defrosting bypass pipe has in a view perpendicular to the bottom plate (top view on the bottom plate) a curvature (curved portion) so that it does not pass straight over the drainage hole. Nevertheless and due to space restrictions a minor overlap of the additional defrosting bypass pipe at the outer edges of the drainage hole may occur.

As a result, the open area/cross-section of the drainage hole may be kept as big as possible to support quick and complete drainage of the water from the bottom plate to the outside.

A more complete appreciation of the present disclosure and many of the attendant advantages thereof will be readily obtained as the same becomes better understood by reference to the following detailed description when considered in connection with the accompanying drawings.

BRIEF DESCRIPTION OF DRAWINGS

FIG. 1 shows a perspective view of an outdoor unit in accordance with the present disclosure, wherein a front panel including a grille and a valve mouth are removed and the heat source heat exchanger is schematically shown transparently;

FIG. 2 shows a partially enlarged cross-sectional view of the outdoor unit in FIG. 1 along a horizontal plane, wherein the heat source heat exchanger is schematically shown transparently;

FIG. 3 shows a partially enlarged perspective view of the outdoor unit in FIG. 1, wherein the heat exchanger has been removed;

FIG. 4 shows a partially enlarged cross-sectional view of the outer unit in FIG. 1 along a vertical plane, wherein the heat source heat exchanger is schematically shown transparently;

FIG. 5 shows a piping diagram of a heat pump implementing an outdoor unit as shown in FIG. 1.

DESCRIPTION OF EMBODIMENTS

An embodiment will now be explained with reference to the drawings. It will be apparent to those skilled in the field of heat pumps from this disclosure that the following description of the embodiment is provided for illustration only and not for the purpose of limiting the invention as defined by the appended claims.

FIG. 1 shows a perspective view of an outdoor unit 10 of a split type heat pump 1 (FIG. 5).

The heat pump 1 comprises the outdoor unit 10 and an indoor unit 100. The indoor unit 100 comprises a heat consumer heat exchanger (indoor heat exchanger 101) and an indoor fan 102.

In the present example, the outdoor unit 10 comprises a heat source heat exchanger 11 and an outdoor fan 12. Additional components that may be accommodated in the outdoor unit 10 are a compressor 13, an accumulator 14, an expansion valve 15 and/or a 4-way switching valve 16.

Referring to FIG. 5, the components of the refrigerant circuit are connected by refrigerant pipes. In this context, a refrigerant pipe 17 (discharge pipe) is connected to the discharge side of the compressor 13 and the 4-way switching valve 16. Moreover, the 4-way switching valve 16 is connected by a refrigerant pipe 18 to the heat source heat exchanger 11. A liquid refrigerant pipe 19 connects the heat source heat exchanger 11 and the expansion valve 15.

The outdoor unit 10 and the indoor unit 100 are connected by a liquid refrigerant connection pipe 20 and a gaseous refrigerant connection pipe 21. The liquid refrigerant connection pipe connects to the expansion valve 15 and the heat consumer heat exchanger 101. The gaseous refrigerant connection pipe 21 connects to the heat consumer heat exchanger 101 and the 4-way switching valve 16.

Moreover, the 4-way switching valve 16 is connected by a further refrigerant pipe 22 to the accumulator 14, which in turn is connected to an inlet side of the compressor by a refrigerant piping 23.

During heating operation of the heat pump 1, which is indicated by the solid lines and arrows in FIG. 5, refrigerant discharged from the compressor 13 flows via the discharge pipes 17, the 4-way switching valve 16 and the gaseous refrigerant connection pipe 21 through the heat consumer heat exchanger 101 functioning as a condenser.

Subsequently, liquid refrigerant flows from the heat consumer heat exchanger 101 via the liquid refrigerant connection pipe 20, the expansion valve 15 and the liquid refrigerant pipe 19 to the heat source heat exchanger 11 functioning as an evaporator.

Gaseous refrigerant leaves the heat source heat exchanger 11 and flows via the refrigerant pipe 18, the 4-way switching valve 16, the refrigerant piping 22, the accumulator 14 and the refrigerant piping 23 to the inlet side of the compressor 13.

During heating operation, when the heat source heat exchanger 11 functions as evaporator, frost is formed on the heat source heat exchanger 11. The formation of frost reduces the heat exchange efficiency of the heat source heat exchanger 11. Thus, a defrosting operation has to be performed on a regular basis.

During defrosting operation, the above cycle is reversed, which is indicated in FIG. 5 by the dotted lines and the dotted arrows.

During defrosting operation, refrigerant discharged from the compressor 13 flows via the discharge pipe 17, the 4-way switching valve 16 and the refrigerant pipe 18 through the heat source heat exchanger 11 functioning as a condenser. Thereby, the heat source heat exchanger 11 is heated and any frost formed thereon is thawed.

Subsequently, liquid refrigerant flows from the heat source heat exchanger 11 via the liquid refrigerant pipe 19, the expansion valve 15 and the liquid refrigerant connection pipe 20 to the heat consumer heat exchanger 101 functioning as an evaporator.

Gaseous refrigerant leaves the heat consumer heat exchanger 101 and flows via the gaseous refrigerant connection pipe 21, the 4-way switching valve 16, the refrigerant piping 22, the accumulator 14 and the refrigerant piping 23 to the inlet side of the compressor 13.

In the following, the structure of the outdoor unit 10 is explained in more detail with reference to FIGS. 1 to 4.

The shown outdoor unit 10 comprises a casing 30. The casing 30 has a top plate 33 and a side plate 34. In the shown embodiment, the side plate 34 extends around a rearward corner of casing 30 of the outdoor unit 10 being connected to (integrally formed with/forming a one piece structure with) a back plate 35 of the casing 30.

Further, the casing 30 has a bottom plate 31. Feet 32 (see FIGS. 1 and 3) for mounting the outdoor unit on a horizontal surface or via brackets to a vertical wall are fixed to the bottom plate 31.

The bottom plate 31 has a base 36. The feet 32 are attached to a lower side of the base 36. A circumferential flange 37 protrudes outward from the base 36. Thus, the flange 37 is basically oriented vertically, whereas the base 36 is oriented horizontally. The flange 37 may extend about the entire circumference of the base 36. Thus, the bottom plate 31 resembles a drain pan.

A drainage structure 38 is provided in the base 36 of the bottom plate 31. This drainage structure 38 comprises a plurality of channels 39*a*-39*e*. Moreover, the drainage structure 38 comprises a drainage hole 40. In the example, the drainage hole 40 is positioned within the drainage channel 39*a*. The drainage channels 39*a*-39*e* guide any water accumulated on the base 36 of the bottom plate 31 towards the drainage hole 40. The drainage hole 40 is connected to a drainage port 41 at a lower side of the bottom plate 31 in order to lead any water away from the outdoor unit 10.

The outdoor fan 12 is as well accommodated in the casing 30 of the outdoor unit 10. The outdoor fan 12 is fixed to the base 36 of the bottom plate 31 via a support structure 42. A fan motor 43 is attached to the support structure 42 and rotationally supports a fan rotor 44 including fan blades 45. In the depicted embodiment, the support structure 42 is directly screwed onto the base 36 of the bottom plate 31. The drainage channels 39*c* and 39*e* pass by the support structure 42 and particularly the portion of the base 36 to which the support structure is fixed.

As will be best visible from FIG. 2, the heat source heat exchanger 11 occupies a part of the rear side of the casing 30 and the side of the casing 30 opposite to the side plate 34. The heat source heat exchanger 11 is "L"-shaped in a top view.

The heat source heat exchanger 11 is supported on an upper surface of the base 36 as shown in FIG. 4. The drainage channels 39*a* basically follow an outer edge portion of the base 36 at which the heat source heat exchanger 11 is supported on the base 36. Thus, a lower side 11*c* of the heat source heat exchanger 11 is directed towards the base 36 and the drainage channel 39*a*. The heat source heat exchanger 11 may even close an upper opening of the drainage channels 39*a*.

Further, the heat source heat exchanger 11 is positioned on the bottom plate 31 so that an outer side 11*a* of the heat source heat exchanger 11 is positioned inside the flange 37 or more particularly an inner surface 37*a* of the flange 37.

As previously mentioned, the heat source heat exchanger 11 is heated during the defrosting operation, whereby any frost formed thereon melts. Accordingly, water flows along surfaces of the heat source heat exchanger 11 including the outer side 11*a* and an inner side 11*b* of the heat source heat exchanger 11 downwards to the bottom plate 31. Some of the water will flow in the gap between the inner side 37*a* of the flange 37 and the outer side 11*a* of the heat source heat exchanger 11.

Some of the water will also flow towards the drainage structure 38 in the base 36 of the bottom plate 31. This water is guided via the drainage channels 39*a-e* towards the drainage hole 40 and from there via the drainage port 41 away from the outdoor unit 10.

In order to prevent the formation of ice during the defrosting operation in a portion between the inner side 37*a* and the outer side 11*a*, a defrosting bypass pipe 50 is provided in the space between the inner side 37*a* of the flange 37 and the outer side 11*a* of the heat source heat exchanger 11. The defrosting bypass pipe 50 comprises a lower pipe 50*a* and an upper pipe 50*b*. The lower pipe 50*a* and the upper pipe 50*b* extend vertically parallel to each other. Thus, the upper pipe 50*b* is further away from the base 36 than the lower pipe 50*a*.

The lower pipe 50*a* and the upper pipe 50*b* are connected by a bend 50*c* at one end forming a loop. The opposite ends of the lower pipe 50*a* and the upper pipe 50*b* are respectively connected indirectly or directly to the discharge pipe 17 and the liquid refrigerant pipe 19 (FIG. 5).

Moreover, an additional defrosting bypass pipe 60 is provided underneath the heat source heat exchanger 11, particularly underneath the lower side 11*c* of the heat source heat exchanger 11. In the shown example, the additional defrosting bypass pipe 60 is disposed within the drainage channels 39*a*. The additional defrosting bypass pipe 60 comprises an outer pipe 60*a* and an inner pipe 60*b*. The outer pipe 60*a* and the inner pipe 60*b* extend horizontally parallel to each other. Thus, the inner pipe 60*b* is further away from the inner side 37*a* of the flange 37 than outer pipe 60*a*.

The outer pipe 60*a* and the inner pipe 60*b* are connected at one end by a bend 60*c* forming a loop. The opposite ends of the outer pipe 60*a* and the inner pipe 60*b* are respectively connected indirectly or directly to the discharge pipe 17 and the liquid refrigerant pipe 19 (FIG. 5).

Moreover, the additional defrosting bypass pipe 60 has an auxiliary loop 61. The auxiliary loop 61 is formed by bending the defrosting bypass pipe 60 so as to extend towards the support structure 42 of the outdoor fan 12. In the example, the auxiliary loop 61 extends from the drainage channel 39*a* into the drainage channel 39*c* passing by the support structure 42. In this context, the inner and outer pipes 60*a* and 60*b* are bent outward away from the flange 37 and respectively connected (brazed) by a 180 degree bend 61*a*. As will be best apparent from FIG. 2, the connecting portions, i.e. the portions where the bends 61*a* are respectively connected (brazed) to the inner and outer pipes looks out from the heat source heat exchanger 11 in a top view. Thus, the brazed portions may be readily inspected without having to remove the heat source heat exchanger 11 for maintenance. The bend 60*c* as well looks out from the heat source heat exchanger 11 (see FIG. 1) so that also this connection portion may readily be inspected without having to remove the heat source heat exchanger 11. The bend 50*c* is visible anyway when inspecting the gap between the inner side 37*a* of the flange 37 and the outer side 11*a* of the heat source heat exchanger 11.

In addition, the additional defrosting bypass pipe 60 comprises a curved portion 62 passing around the drainage hole 40 (FIG. 2) in order to block at most a minor portion of the cross-section of the drainage hole 40 and thereby enable a reliable drainage of water via the drainage hole 40.

As will be apparent from FIG. 5, the defrosting bypass pipe 50 and the additional defrosting bypass pipe 60 are connected in parallel. A valve 63 may be provided in order to control the flow of gaseous refrigerant into the defrosting bypass pipe 50 in the additional defrosting bypass pipe 60 during defrosting operation. Alternatively to the valve 63, two valves 63*a* and 63*b* may be provided respectively in the defrosting bypass pipe 50 and the additional defrosting bypass pipe 60, which would allow independent control of the flow in the respective pipes 50 and 60. A controller 70 is provided to control the valve 63 or alternatively the valves 63*a* and 63*b*. In particular, the controller 70 opens the valve 63 or alternatively the valves 63*a* and 63*b* in the defrosting operation and closes the valve 63 or alternatively the valves 63*a* and 63*b* in a normal operation, such as heating operation.

As a consequence, during defrosting operation hot gaseous refrigerant flows through the defrosting bypass pipe 50 and the additional defrosting bypass pipe 60.

Accordingly, the space between the inner side 37*a* of the flange 37 and the outer side 11*a* of the heat source heat exchanger 11 is heated by the defrosting bypass pipe 50 preventing the formation of ice in said space.

Similarly, the drainage channel 39*a* is heated by the additional defrosting bypass pipe 60 so that the formation of ice in the drainage channel 39*a* is avoided. Due to the auxiliary loop 61 which extends towards the support structure 42 into the drainage channel 39*c*, a portion in the vicinity of the support structure 42 is heated and the formation of ice at the support structure 42 may be prevented. Accordingly, displacement of the support structure 42 due to the formation of ice can be avoided.

It is to be understood that the present description of an embodiment is not considered to be limiting. Rather several modifications may be realized by the skilled person. For example, more than one auxiliary loop can be provided in the additional defrosting bypass pipe 60. Further, the defrosting bypass pipe 50 and/or the additional defrosting bypass pipe 60 may also be connected to the liquid refrigerant connecting pipe 20. Even further it is also conceivable to connect one end of the defrosting bypass pipe 50 and/or the additional defrosting bypass pipe 60 to the discharge pipe 17 and the other opposite end to the refrigerant pipe 18 rather than the liquid refrigerant pipe 19 or a liquid refrigerant connecting pipe 20.

REFERENCE SIGNS LIST

1 heat pump
10 outdoor unit
11 heat source heat exchanger
11*a* outer side
11*b* inner side
11*c* lower side
12 outdoor fan
13 compressor
14 accumulator
15 expansion valve
16 4 way switching valve
17 discharge pipe
18 refrigerant pipe
19 liquid refrigerant pipe
20 liquid connection pipe
21 gaseous connection pipe
22 refrigerant pipe
23 refrigerant pipe
30 casing
31 bottom plate
32 foot
33 top plate
34 side plate
35 back plate
36 base of the bottom plate
37 flange
37*a* inner side of the flange
38 drainage structure
39*a-e* drainage channels
40 drainage hole
41 drainage port
42 support structure
43 fan motor
44 fan rotor
45 fan blade
50 defrosting bypass pipe
50*a* lower pipe
50*b* upper pipe
50*c* bend
60 additional defrosting bypass pipe
60*a* outer pipe
60*b* inner pipe
60*c* bend
61 auxiliary loop
61*a* bend
62 curved portion
100 indoor unit
101 heat consumer heat exchanger
102 indoor fan

The invention claimed is:

1. An outdoor unit for a heat pump comprising a refrigerant circuit, the outdoor unit comprising:

a compressor;

a discharge pipe of the refrigerant circuit connected to a discharge side of the compressor;

a bottom plate, the bottom plate having a base and an outer flange protruding upward from an outer edge of the base;

a heat source heat exchanger supported on the bottom plate;

and a defrosting bypass pipe connected at one end to the discharge pipe, the defrosting bypass pipe being arranged between an inner side of the flange and an outer side of the heat source heat exchanger.

2. The outdoor unit according to claim 1, wherein the defrosting bypass pipe is a loop comprising an upper pipe and a lower pipe, wherein the upper pipe is further away from the base of the bottom plate than the lower pipe.

3. The outdoor unit according to claim 1, further comprising an additional defrosting bypass pipe connected at one end to the discharge pipe, the additional defrosting bypass pipe being arranged between the base of the bottom plate and a lower side of the heat source heat exchanger.

4. The outdoor unit according to claim 3, wherein the additional defrosting bypass pipe comprises an auxiliary loop which is in a view perpendicular to the bottom plate not located below the heat source heat exchanger.

5. The outdoor unit according to claim 4, wherein the additional defrosting bypass pipe is made of at least two tubes connected to each other at a connecting portion, the connecting portion being positioned in the auxiliary loop so that the connecting portion is in a view perpendicular to the bottom plate not located below the heat source heat exchanger.

6. The outdoor unit according to claim 5, wherein the auxiliary loop extends towards a support structure supporting a fan on the bottom plate in a view perpendicular to the bottom plate.

7. The outdoor unit according to claim 5, wherein the defrosting bypass pipe and the additional defrosting bypass pipe are connected in parallel.

8. The outdoor unit according to claim 5, wherein the additional defrosting bypass pipe passes around a drainage hole in the bottom plate.

9. The outdoor unit according to claim 4, wherein the auxiliary loop extends towards a support structure supporting a fan on the bottom plate in a view perpendicular to the bottom plate.

10. The outdoor unit according to claim 9, wherein the defrosting bypass pipe and the additional defrosting bypass pipe are connected in parallel.

11. The outdoor unit according to claim 9, wherein the additional defrosting bypass pipe passes around a drainage hole in the bottom plate.

12. The outdoor unit according to claim 4, wherein the defrosting bypass pipe and the additional defrosting bypass pipe are connected in parallel.

13. The outdoor unit according to claim 4, wherein the additional defrosting bypass pipe passes around a drainage hole in the bottom plate.

14. The outdoor unit according to claim 3, wherein the defrosting bypass pipe and the additional defrosting bypass pipe are connected in parallel.

15. The outdoor unit according to claim 14, wherein a valve is arranged in each of the defrosting bypass pipe and the additional defrosting bypass pipe.

16. The outdoor unit according to claim 15, further comprising a controller, wherein the controller is configured to close the valve/-s during normal operation and to open the valve/-s during a defrost operation.

17. The outdoor unit according to claim 14, wherein a valve is arranged to control the flow of refrigerant from the discharge pipe through both the defrosting bypass pipe and the additional defrosting bypass pipe.

18. The outdoor unit according to claim 17, further comprising a controller, wherein the controller is configured to close the valve/-s during normal operation and to open the valve/-s during a defrost operation.

19. The outdoor unit according to claim 14, wherein the additional defrosting bypass pipe passes around a drainage hole in the bottom plate.

20. The outdoor unit according to claim 3, wherein the additional defrosting bypass pipe passes around a drainage hole in the bottom plate.

* * * * *